US005262740A

United States Patent [19]

Willems

[11] Patent Number: 5,262,740

[45] Date of Patent: Nov. 16, 1993

[54] MICROSTRIP TRANSFORMER APPARATUS

[75] Inventor: David A. Willems, Salem, Va.

[73] Assignee: ITT Corporation, New York, N.Y.

[21] Appl. No.: 866,148

[22] Filed: Apr. 9, 1992

[51] Int. Cl.[5] ..... H01P 5/10; H01P 5/00

[52] U.S. Cl. ..... 333/26; 333/33; 333/35; 333/238

[58] Field of Search ..... 333/116, 26, 246, 238, 333/25, 32, 33, 35; 336/200

[56] References Cited

U.S. PATENT DOCUMENTS 3,012,210 12/1961 Nigg ..... 333/116
3,904,991 9/1975 Ishii et al. ..... 333/116
4,532,484 7/1985 Tajima et al. ..... 333/116

*Primary Examiner*—Paul Gensler
*Attorney, Agent, or Firm*—Arthur L. Plevy; Patrick M. Hogan

[57] ABSTRACT

A transmission line structure operates as a transformer and includes at least two intertwined serpentine planar transmission lines positioned on a substrate with the lines repeatedly crossing each other with said areas of crossing including an airbridge or other structure which physically isolates one line from the other.

8 Claims, 2 Drawing Sheets

MICROSTRIP TRANSFORMER APPARATUS

FIELD OF THE INVENTION

This invention relates to high frequency transformers and more particularly to a microstrip transmission line transformer.

BACKGROUND OF THE INVENTION

Transmission line transformers have been used at RF frequencies for many years to give broadband performance. Because the energy is coupled by a transverse transmission line mode rather than by flux linkages, as in the conventional transformers, the stray inductances and interwinding capacitances are absorbed into the characteristic impedance of the transmission line. Therefore, the response of the transmission line transformer is limited by the deviation of the characteristic impedance from the optimum value, the unabsorbed parasitics, and the length of the transmission line. The transformer does not operate as a transformer when a transmission line is a half wave length long.

Essentially the transmission lines operate in many different modes as when two transmission lines are physically close together the electromagnetic field on one affects the other so that energy can be coupled from one line to another. The coupled lines are assumed to support only transverse electromagnetic (TEM) waves so that a DC capacitance equivalent circuit can model the coupled transmission line circuit. Basically, a pair of coupled transmission lines with a common ground exhibit an equivalent circuit which includes ideal transformers. These structures are well known. See for example a text entitled "Microwave Semiconductors Circuit Design" by W. Allan Davis published by Van Nostrand Reinhold Company, 1984, Chapter 3 entitled "Impedance Transformers and Filters".

At RF frequencies (1 MHz to 100 MHz) transmission line transformers are constructed by coiling the transmission line on a ferrite core so that undesired modes are inhibited. Typically a transformer of this type could be made having a bandwidth of several decades in frequency. These types of transformers also have been constructed at microwave frequencies using a microstrip or planar approach. See an article entitled "Analysis of Rectangular Spiral Transformers for MMIC Applications" by A. Boulouard and M. E. Le Rouzic in "IEEE Transactions on Microwave Theory and Techniques", Vol. 37, No. 8, August 1989. The trifilar transformer described in that article is typical of the prior art as it consists of three parallel coupled lines wrapped in a spiral in a planar surface. The resulting transformer gives slightly better than an octave bandwidth.

Such transformers have problems which result from the physical configuration of the transformer. Certain of the problems exist because the outside and inside lines have a different characteristic impedance than the center line. Normally the outside line is longer than the inside line and the even and odd mode phase velocities travel at different speeds thus further creating problems with the designs.

The prior art devices were used in microwave monolithic integrated circuits (MMICs) on gallium arsenide (GaAs) substrates.

The use of such transformers on such substrates employing microstrip or planar techniques is extremely desirable and it is an object of the present invention to provide a microstrip transformer apparatus which can be fabricated on a planar surface using either microstrip or other planar technology.

DETAILED DESCRIPTION OF THE FIGURES

Figure 1:
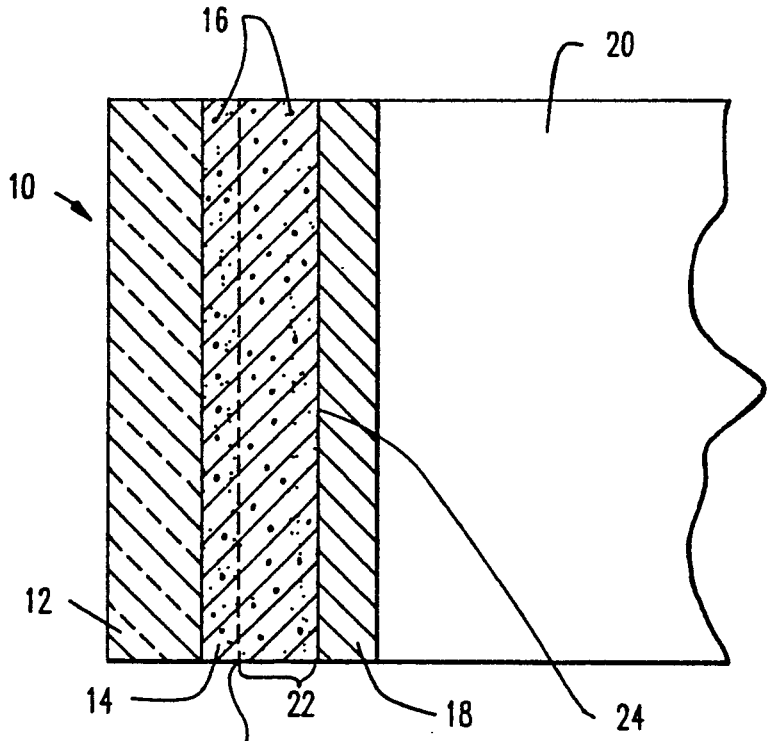
(PRIOR ART) FIG. 1
FIG. 1 is a top planar view of an interleaved microstrip transformer according to this invention.

Referring to FIG. 1 there is shown a top view of a transmission line structure which can be employed as a trifilar transformer. As one can ascertain, the transmission lines depicted in FIG. 1 consist of three separate lines, 11, 12 and 13. Each line basically is fabricated by the deposition of suitable conducting material on a planar substrate. For example, the substrate may be gallium arsenide and the lines may be fabricated as a microstrip configuration. As one will understand, microstrip has only one ground plane with the conductor supported by a layer of dielectric and microstrip structures do not truly support TEM propagation. Microstrip (MS) is the most popular transmission line configuration for monolithic IC applications (MIC) due to the following:

1. Passive and active elements are easily inserted in series with the MS strip conductor on the surface of the chip.
2. The metallized ground plane on the back of the substrate can be used both as a mounting surface and as a heat sink for the heat generated by the active devices on the substrate.
3. A large body of theoretical experimental data exists for the microstrip configuration.
4. The losses and dispersions are low while the output impedance range is moderate.

A disadvantage of microstrip is due to its non-coplanar geometry which makes it difficult to connect elements in shunt to ground. Microstrip techniques are well known and have been widely utilized in both the technology involving microwave integrated circuits (MICs) and monolithic microwave integrated circuits (MMICs). As one can understand, the apparatus of FIG. 1 can be desirably fabricated from microstrip techniques or from planar techniques in general. When employing microstrip one would form the separate transmission lines on a gallium arsenide substrate. One can also employ other types of substrates, as well as using stripline or other type of technology.

As seen from FIG. 1, each of the transmission lines 11, 12, and 13 are braided or intertwined together. Each line basically is of a triangular configuration of a zig-zag pattern. This configuration is easy to produce employing typical photolithographic techniques or other techniques. Other configurations may suffice as well, such as serpentine or sinusoidal types of patterns. While three lines 11, 12 and 13 are shown to provide a trifilar configuration, only two lines, as 11 and 12, are required to provide coupling of electromagnetic fields. The two coupled lines will support TEM waves and provide the many structures used in the prior art for parallel or edge coupled lines. See the above noted text page 62, paragraph 3.4 entitled "Coupled Transmission Lines". The intertwining of the lines enables tighter coupling while further assuring that the even and odd mode velocities are equalized due to the serpentine line configuration. Each of the three lines are braided or interleaved with respect to each other. In FIG. 1 it is seen that each line crosses another line in a manner so there is no more than two conductors crossing in one place. At each crossing as 15 and 16, there is provided an airbridge which serves to physically separate and electrically isolate one conductor from another. While the conductors are intertwined or braided, they do not touch one another and are insulated from one another at each point of crossing by means of the airbridges 15 and 16. While airbridges are provided, the area of the crossings of the lines can be electrically isolated by other integrated circuit techniques, such as by multiple layer arrangements and so on.

Also shown in FIG. 1, the ends of the respective conductors are referenced by reference numerals at the right end of 1, 2 and 3 and reference numerals at the left end of 4, 5 and 6. As one can ascertain, the line 11 has a terminal designated by reference numeral 3 at one end and has an output at the left end designated by reference terminal 6. The transmission line 12 has a right terminal designated by reference numerals 2 and a left terminal designated by reference numeral 5. The transmission line 13 has the right terminal designated by reference numeral 1 and the left terminal designated by reference numeral 4. As one can see, each of the lines are intertwined or braided to form the structure shown in FIG. 1. It is also understood that the lines are only shown as a partial length and that is why each of the ends are fragmented to indicate that the lines could be of any desired length and also can be directed over any path in the manner of the braided interconnection shown. Typically, each line may be a quarter of a wavelength long at the RF frequency to be accommodated. As one can see, each line consists of triangular patterns having equal negative and positive slopes and of the same length, although other patterns and shapes may suffice. The lines should preferably be of the same shape, length and size to assure proper impedance and optimum coupling. The lines have their patterns staggered as shown and the spacing equalized to provide a waveform pattern.

Figure 2:
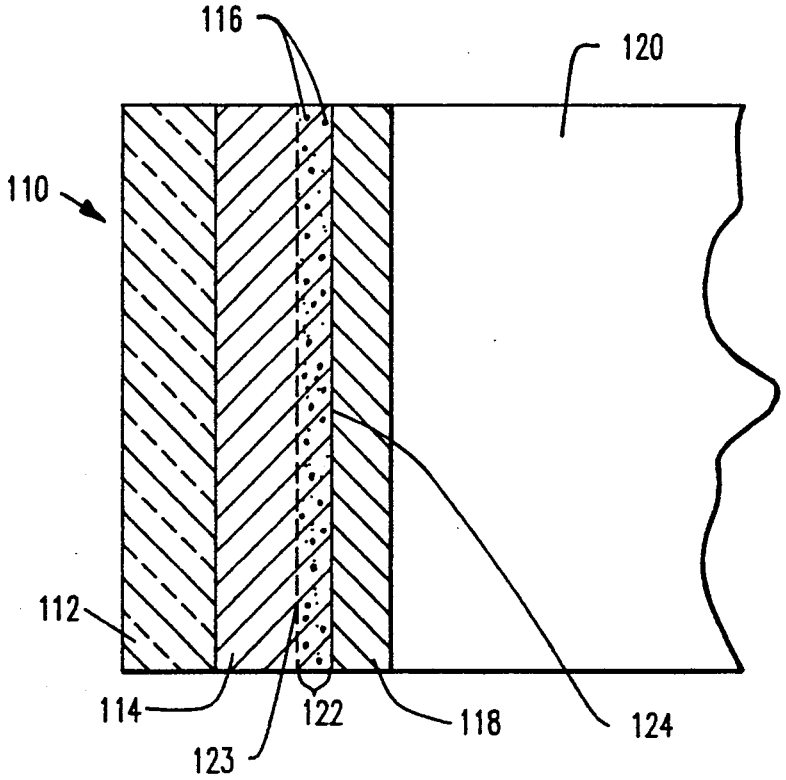
FIG. 2 is a cross-sectional view depicting the formation of an airbridge which is employed in the transformer configuration shown in FIG. 1.

Referring to FIG. 2, there is shown a typical example of an airbridge to provide the crossing between lines as for example that of 15, shown in FIG. 1. As seen in FIG. 2, the airbridge is designated by a metallic connection 33 which bridges the metallic central conductor 30. The metallic airbridge 33 couples metallic section 31 to metallic section 32, thus metallic section 31 is directly connected to section 32 by means of the airbridge 33 and is isolated from the center conductor 30. In this manner, terminals or areas 31, 33 and 32 can constitute the conductor 12 while the central conductor 30 can constitute conductor 11 of FIG. 1. In this manner the conductor or transmission line 12 is physically isolated from transmission line 11 by means of the airbridge 15 as shown in FIG. 1 and as shown in cross section in FIG. 2. Airbridges are quite well known and accomplished in MMIC fabrication. In many sections of an MMIC, a connection is required between non-adjacent metallized areas such as 31 and 32.

The airbridge is a bridge of metal running above the surface of the circuit, as metal 33 and directed between the areas to be connected. These are formed by a photoresist and a plating process which basically can be implemented by many different techniques. One technique will be briefly alluded to in regard to FIG. 2. FIG. 2 depicts a cross-section of a microstrip-type of circuit with a ground plane 35 fabricated from a metal with a dielectric layer 36 and with conducting members 32, 30 and 31 deposited directly on the top surface of the dielectric layer 36. In order to connect the terminals or metal areas 31 to 32, the airbridge 33 is provided. The airbridge is formed by careful control of the resist thickness and plating conditions and a very strong bridge can be formed. Properly executed, the process can produce well-defined bridges between metal lands anywhere across a GaAs slice.

Basically, a resist 34 would be deposited between metal land layers 31 and 32. After the resist is deposited, a plating seed layer would then be formed over the resist connecting layer 31 with layer 32. Then the seed layer would be plated to a greater depth to form the layer 33 and the land areas would further be protected by a protective resist while the inner resist 34 would be removed by conventional techniques. Alternate interconnection process is to use multi levels of dielectric films. In such a process a metal film as 33 can be made to run from terminal 31 to terminal 32 between two different layers of dielectric. This can also be implemented utilizing conventional techniques.

Thus, as one can see, the entire braided configuration or interleaved transmission line configuration depicted in FIG. 1 can be implemented by normal semiconductor processing techniques utilizing airbridges or the means to enable the transmission line conductors to be isolated one from the other while being intertwined as shown in FIG. 1.

The topology shown in FIG. 1 assures that all lines have identical impedances. This increases the coupling which allows for a lower characteristic impedance while it further can force or assure that all three of the line lengths are identical when spiraled into various transformer configurations. The structure slows the odd mode velocity by increasing its path with respect to the even mode velocity because of the serpentine configuration of the transmission lines. In microstrip, the even mode travels in the dielectric layer 36 while the odd mode travels in air and the dielectric. Due to this, the odd mode travels faster reducing the effective bandwidth of the device. As one can see, based on the zigzag configuration, the odd mode is slowed up with respect to the even mode and therefore the spiraling slows the odd mode velocity by increasing its path with respect to the even mode.

Based on FIG. 1, one can ascertain that the structure can be manufactured in microwave integrated circuit or monolithic microwave integrated circuit technology employing airbridges. One can also ascertain that the structure requires that no more than two conductors cross in one place. The lower characteristic impedance is necessary in applications where one desires to produce a trifilar transformer which therefore enables an impedance transform to a low value. For example, if 50 ohms is to be transformed to 5.56 ohms, each of the lines is required to have a 16.7 ohm characteristic impedance. This is indicated because the trifilar transmission line transformer has a 9:1 transform ratio. Other structures which require coupling between two signals can be implemented using the intertwined construction as shown in FIG. 1. The odd and even mode velocities must be equalized to expand the bandwidth when the transmission line transformer is being used as a balun. The braided or interleaved transmission line structure depicted in FIG. 1 can have many other uses.

Figure 3:
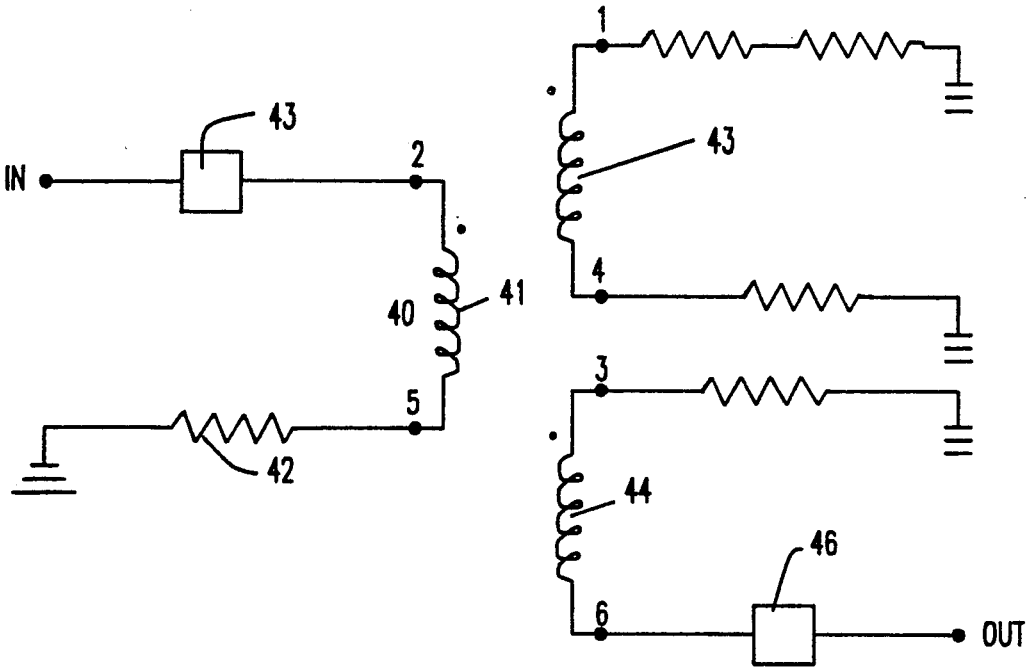
FIG. 3 is a circuit diagram showing one type of transformer which can be implemented by means of the microstrip configuration depicted in FIG. 1.
Figure 4:
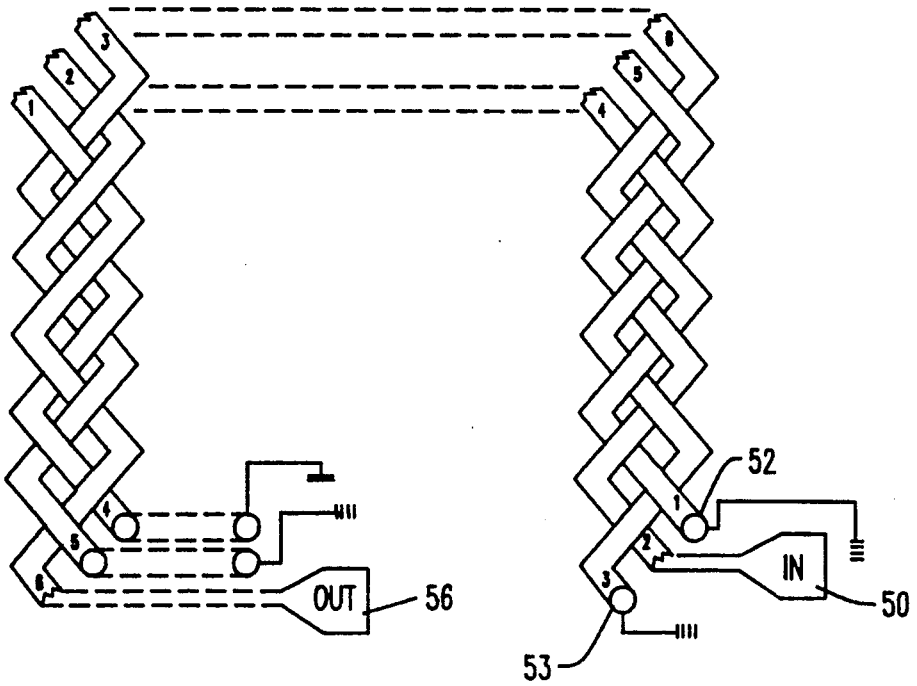
FIG. 4 shows one embodiment of a trifilar transformer which is implemented according to the above-described teachings.

Referring to FIG. 3, there is shown a schematic diagram of a typical transformer which can be implemented by the configuration shown in FIG. 1. As one can see, the numerals on each of the theoretical windings of the transformer constitute the numerals indicated in FIG. 1 as 1, 2, 3, 4, 5 and 6. Thus, as one can see, there is shown in FIG. 3 a primary winding circuit 40 which essentially consists of a primary winding 41 with terminal 5 of the transmission line directed through an inductor 42 to reference potential. As one will understand, inductances can be implemented by strip line techniques by a suitable length of line and so on. Terminal 2 which, for example, constitutes the right terminal of line 12, is directed through a suitable impedance network 43 which is again directed to an input terminal or terminal land area which receives a source of RF signal. Essentially the circuit of FIG. 3 can be constructed as shown in FIG. 4 by means of a terminal pad configuration 50 which is directly coupled to the end of line 12 designated by the numeral 2. This can be directly coupled to the end of the line or can be coupled by parallel edge coupling, all of which techniques are well known.

Thus, as seen in FIG. 3, transmission line 12 is analogous to the primary winding 41, transmission line 13 constitutes the secondary winding 45 in FIG. 3 while transmission line 11 constitutes the secondary winding 44. It is seen that terminal 6, which is the left hand terminal of transmission line 11, is coupled via an output pad 46 to an output terminal. It is also seen that terminal 3, which is the right hand terminal of transmission line 11 is coupled through an inductor to reference potential or ground as is terminal 1 of secondary winding 45 which is coupled through a resistor and inductor to reference potential.

As seen in FIG. 2, reference potential is available at the ground plane 35. In order to connect the various terminals or the lines to the ground plane, one utilizes via hole technology. This technology is well known and is used to remove the constraint of grounding the circuit about its periphery. To produce such a via hole, a process is employed which holes are made from the top or back of the wafer, namely to contact the ground planes on the top or back of the wafer. Once the holes are made they can be filled by appropriate metallization which makes a direct contact to the front side of the areas required to be grounded. In this manner, by referring to FIG. 4, there is shown the intertwined transmission line which assumes, for example, a loop type of pattern for space conservation. The transmission line, which is intertwined, has an input designated by terminal area 50 which is connected for example to terminal 2 of transmission line 12 with the respective terminals as 1 and 3 of transmission lines 13 and 11 connected to ground, as indicated, via via holes 52 and 53 implemented in the substrate.

In a similar manner, an output land area 56 is shown for example connected to terminal 6 via the transmission line 11 with terminals 4 and 5 of transmission lines 13 and 12 connected via via holes to the ground reference plane. It is indicated that the suitable impedances, such as resistors and inductors, can also be implemented by conventional techniques.

The circuit shown in FIG. 4 can operate as a trifilar transformer or, for example, can be implemented as a balun. This constitutes a 180° phase difference between signals at the two transformer or secondary windings 45 and 44. Transformers can be configured in many different ways using this structure.

Essentially, the configuration can be manufactured with present process technology using airbridge isolation at the crossing points. Each of the lines, as indicated, alternates between a crossing above and below every other line and requires no more than two layers of metal. The configuration enables one to control the impedance of all lines, as the impedance of all lines will be identical due to the intertwined configuration. It allows tight coupling of each of the transmission lines because the lines are essentially intertwined or braided together. The configuration lowers the characteristic impedance as above described, for example, to enable a transition impedance from a 5.56 ohms to 50 ohms which would require a 16.7 ohm characteristic impedance for each of the three lines. All lines are the same length when coiled in the manner shown. The braided planar configuration has a broader frequency response than an ordinary planar transformer, as shown in the prior art. The device also can absolutely control phase velocity differences because the odd mode is slowed with respect to the even mode. This is so because of the fact that the odd mode will travel along the serpentine or triangular pattern while the even mode basically travels in the dielectric.

What is claimed is:

1. A planar transmission line structure comprising:
a substrate;
a first serpentine transmission line located on a top surface of said substrate;
a second serpentine transmission line intertwined with and crossing said first line at given points with said second line electrically isolated from said first line at said points of crossing;
at least a third transmission line intertwined with said first and second lines and physically crossing said lines and isolated therefrom at said crossings;
isolation means located at said points of crossing between said lines to physically isolate said lines from one another at each of said points of crossing;
terminal means coupled to said first and second lines adapted to enable said lines to receive an RF signal; and
means coupled to said first, second and third lines to provide a trifilar transformer operation.

2. The transmission line structure according to claim 1 wherein:
said isolation means located at said points of crossings between said lines includes an airbridge connecting one portion of one line to another portion of the same line with said bridges running and crossing said other line.

3. The transmission line structure according to claim 1 wherein each line is of a repeating triangular configuration.

4. The transmission line structure according to claim 3 wherein a bottom surface of said substrate is metallized to form a ground plane.

5. The transmission line structure according to claim 1 wherein said substrate is gallium arsenide.

6. The transmission line structure according to claim 1 wherein said transmission lines are arranged in an inverted u-shaped configuration to provide a balun transformer operation.

7. The transmission line structure according to claim 1 wherein each line is of a symmetrical repeating zigzag configuration.

8. The transmission line structure according to claim 1 wherein each line is a microstrip transmission line.

* * * * *